US005488899A

United States Patent [19]

Jennings et al.

[11] Patent Number: 5,488,899

[45] Date of Patent: Feb. 6, 1996

[54] APPARATUS FOR PREPARATION OF CANS FOR RECYCLING

[75] Inventors: Jack S. Jennings, R.R. #1, Box 27B Faybrook Rd., Sharon, Vt. 05065; Todd W. Wright, Randolph, Vt.

[73] Assignee: Jack S. Jennings, Sharon, Vt.

[21] Appl. No.: 224,817

[22] Filed: Apr. 8, 1994

[51] Int. Cl.[6] ..... B30B 15/16

[52] U.S. Cl. ..... 100/49; 100/70 R; 100/102; 100/216; 100/902; 134/133; 134/167 R

[58] Field of Search ..... 100/70 R, 71–75, 100/49, 102, 216, 902; 134/57 R, 115 R, 133, 167 R, 168 R

[56] References Cited

U.S. PATENT DOCUMENTS

| | | | |
|---|---|---|---|
| 1,146,845 | 7/1915 | Burham | 134/104.2 |
| 2,668,550 | 2/1954 | Burge | 134/167 R |
| 2,702,557 | 2/1955 | Wiskerchen | 134/52 |
| 2,744,531 | 5/1956 | Martin et al. | 134/133 |
| 3,062,130 | 11/1962 | Huber et al. | 100/216 |
| 3,688,782 | 9/1972 | Smith | 134/167 R |
| 3,817,169 | 6/1974 | Bischoff | 100/216 |
| 4,058,412 | 11/1977 | Knapp et al. | 134/24 |
| 4,126,160 | 11/1978 | Gurtler | 141/91 |
| 4,228,734 | 10/1980 | Parrish | 100/245 |
| 4,396,340 | 8/1983 | Clinton | 100/102 |
| 4,967,776 | 11/1990 | Folmar | 134/57 R |
| 5,174,344 | 12/1992 | Gonzalez-Miller et al. | 100/102 |

FOREIGN PATENT DOCUMENTS

| | | | |
|---|---|---|---|
| 59-16697 | 1/1984 | Japan | 100/902 |
| 5-200594 | 8/1993 | Japan | 100/902 |

*Primary Examiner*—Stephen F. Gerrity
*Attorney, Agent, or Firm*—Woodcock Washburn Kurtz Mackiewicz & Norris

[57] ABSTRACT

An apparatus for preparing cans for recycling which automatically feeds cans one at a time into a cleaning station for cleaning and draining any remaining residue from the cans. At the completion of the cleaning cycle, the cleaned can is fed to a crushing station where the can is crushed to a predetermined thickness and then dropped into a hopper for storage for recycling. In accordance with the invention, three or more aluminum or tinned steel cans may be cleaned and crushed per minute without operator intervention.

21 Claims, 13 Drawing Sheets

38
35
50
70'
52
34
34'
37
54
48
36

WASH ROUTINE

CRUSH ROUTINE

APPARATUS FOR PREPARATION OF CANS FOR RECYCLING

BACKGROUND OF THE INVENTION

1. Field of the Invention

The present invention relates to an apparatus for preparing cans for recycling, and more particularly, to an apparatus for automatically cleaning and crushing aluminum cans, tin-plated steel cans, and the like to facilitate recycling. Similar devices are described in a Disclosure Document entitled "Appliance for Preparation of Materials for Recycling" which was submitted to the U.S. Patent and Trademark Office on Apr. 8, 1992 by one of the present inventors, the disclosure of which is incorporated herein by reference in its entirety.

2. Description of the Prior Art

Recycling has become an increasingly cost-effective manner of providing the raw materials necessary to manufacture many different products. Indeed, aluminum and glass have been recycled in many jurisdictions for several years, with substantial success. However, other materials such as so-called "tin" cans, which are typically tin-plated steel cans, have not been readily recycled. For example, the large tin-plated steel cans such as the 4.25 inch and 6.25 inch diameter cans used by restaurants and other commercial establishments typically are not recycled and instead end up in landfills. To date, recycling of such cans is rare because the cans are relatively bulky and difficult to handle, and the associated cost recovery generally has not justified the extra recycling effort.

Applicants believe that if one were to significantly reduce the volume of cans, such as the tin-plated steel cans just mentioned, thereby reducing the area required to store the cans, that more cans would be recycled. Reducing the volume of such cans would also reduce the amount of space such cans take up in landfills where recycling is not available. In addition, by first rinsing and disposing of the waste in such cans before recycling or other disposal, potential health hazards may be reduced that otherwise could be encountered when storing used cans and lids still containing food particles. Furthermore, applicants believe that if the cans were cleaned and crushed prior to recycling or other disposal that the time taken to prepare the cans used in commercial food preparation for recycling would be drastically reduced. Most importantly, recycling of such cans and lids would be promoted if the recycling process were made easier.

The prior art has failed to address the above-mentioned concerns. While the prior art discloses apparatus for opening and washing cans and for draining the materials from such cans, and other apparatus for crushing such cans, the prior art fails to disclose apparatus for cleaning and crushing cans and the like to facilitate recycling.

For example, Knapp et al. disclose in U.S. Pat. No. 4,058,412 a device for washing a can including a knife having a channel containing a spray nozzle therein for cleaning the can whenever the knife pierces the can. No crushing device is suggested.

Folmar discloses in U.S. Pat. No. 4,967,776 an apparatus for cleaning oil filters by cutting openings in a used oil filter to allow the drainage of excess dirty oil from the oil filter and then rinsing and cleaning the oil filter for disposal. Once again, no crushing device is suggested.

Gurtler discloses in U.S. Pat. No. 4,126,160 a mechanical device adapted to empty a large can by cutting out one end, draining the contents into a container, flushing the can, and then crushing it by means of a ram adapted to press the can onto a ring of sharpened teeth. However, the device disclosed by Gurtler is primarily used for emptying and disposing of metal cans of large sizes used for holding farm chemicals and the like and does not facilitate the cleaning and crushing of a plurality of cans without substantial operator intervention.

Accordingly, a device is still needed which can automatically and economically clean and crush cans to facilitate recycling of such cans. The present invention has been designed for this purpose.

SUMMARY OF THE INVENTION

The present invention addresses the above-mentioned shortcomings of the prior art by providing an automated device for preparing cans for recycling. In particular, the present invention comprises cleaning means for providing a cleaning fluid under pressure into an interior of a can to be recycled, means for feeding cans to the cleaning means and holding the cans in place during cleaning by the cleaning means, crushing means for crushing a can cleaned by the cleaning means to a substantially reduced volume, and control means for detecting the presence of a can at the cleaning means and for controlling respective operations of the cleaning means and the crushing means. Preferably, such an apparatus further comprises a hopper disposed adjacent the crushing means for collecting cans which have been cleaned and crushed by the cleaning means and the crushing means.

A preferred embodiment of the cleaning means comprises a drain and a flush head connected to a water source, where the flush head comprises a nozzle for spraying water under pressure into the interior of the can. Preferably, the cleaning means further comprises means responsive to the control means for inserting the flush head into the can during cleaning and for removing the flush head from the can after a predetermined wash time. Ideally, a sealing flap is also disposed about the flush head, adjacent the nozzle, for substantially closing an open end of the can when the flush head is inserted into the can during cleaning except for a drainage opening at a portion of the open end of the can adjacent the drain. Preferably, a splash flap is also disposed about the flush head on a side of the sealing flap opposite the nozzle for substantially preventing water from splashing out of the drainage opening during cleaning.

A preferred embodiment of the feeding and holding means comprises a gravity in-feed rack having first and second parallel rails for supporting a plurality of cans. Preferably, the first parallel rail is elevated with respect to the second parallel rail such that a can placed with an open end adjacent the first parallel rail is substantially prevented from spilling residue from the can. Preferably, the feeding and holding means further comprises a track for guiding cans from the gravity in-feed rack to the cleaning means. The track preferably contains first and second parallel guide rails for supporting a plurality of cans; however, the parallel guide rail remote from the flush head is preferably elevated with respect to the other parallel guide rail located adjacent the flush head to facilitate drainage of the cleaning fluid from the can during cleaning. In an alternative embodiment, the gravity in-feed rack may be replaced by a wheel driven by a rotary vane piston for supplying cans to the cleaning means one can at a time. Either embodiment may also contain a sensor for detecting an open end of a can for instructing the control means to disable operation of at least the flush head when the open end of the can is not correctly aligned to face the flush head during cleaning by the cleaning means.

A preferred embodiment of the crushing means comprises a hydraulic ram responsive to the control means for driving a first platen from a rest position toward a second platen for compressing a can therebetween. Preferably, the crushing means has a slot adjacent the second platen through which a crushed can falls when the first platen is withdrawn a predetermined distance away from the second platen after crushing of a can. Detecting means are provided for detecting when the first platen has completely crushed the can and for instructing the control means to withdraw the first platen the predetermined distance, pause movement of the first platen for a predetermined time period, and then resuming movement of the first platen to the rest position. This procedure permits the crushed can to pass through the slot into the hopper without falling over between the first and second platens as the first platen is withdrawn. Preferably, a magnet is provided in the crushing means for holding a can in place until the first platen applies a compressive force against the can.

A preferred embodiment of the control means comprises a microprocessor and a sensor disposed with respect to the cleaning means so as to detect the presence of a can in a position ready for cleaning by the cleaning means. This sensor preferably initiates a can cleaning and crushing operation upon detection of the presence of a can in the position ready for cleaning by the cleaning means. Preferably, the control means further comprises a first gate responsive to the microprocessor for regulating the passage of cans to the position ready for cleaning by the cleaning means and a second gate responsive to the microprocessor for regulating the passage of cleaned cans from the cleaning means to the crushing means. The control means may also comprise a plurality of output relays responsive to the microprocessor for selectively applying control signals to the cleaning means and crushing means and open and close signals to the first and second gates.

The crushing means preferably includes a hydraulic pump for applying hydraulic pressure to the crushing means for controlling movement of the crushing means. The movement of the flush head may be controlled by hydraulic pressure from the hydraulic pump or movement provided by an electrical solenoid.

BRIEF DESCRIPTION OF THE DRAWINGS

The above and other objects and advantages of the invention will become more apparent and more readily appreciated from the following detailed description of the presently preferred exemplary embodiments of the invention taken in conjunction with the accompanying drawings, of which.

DETAILED DESCRIPTION OF THE PRESENTLY PREFERRED EMBODIMENTS

An apparatus for the preparation of cans for recycling which affords the above-mentioned and other beneficial features in accordance with the presently preferred exemplary embodiments of the invention will be fully described below with reference to FIGS. 1–14. Those skilled in the art will readily appreciate that the description given herein with respect to those figures is for explanatory purposes only and is not intended in any way to limit the scope of the invention. For example, although the present invention is described as a stand alone apparatus including a hopper, the present invention may also be implemented as a tabletop unit placed over a suitable collection facility. Accordingly, all questions regarding the scope of the invention should be resolved by referring to the appended claims.

Figure 1:
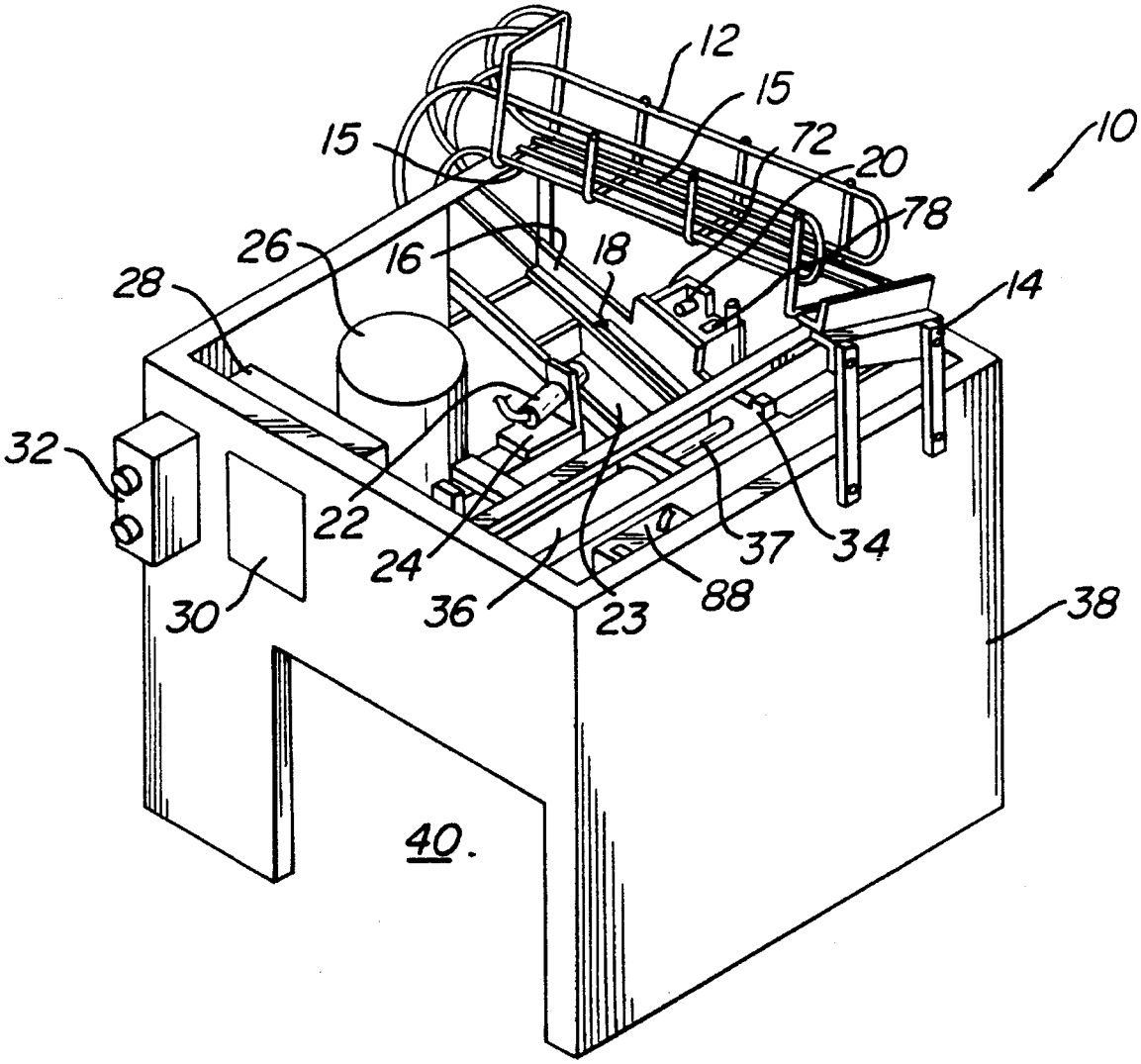
FIG. 1 is a perspective view of an apparatus for preparation of cans for recycling in accordance with the invention.

The presently preferred embodiment of an apparatus 10 for the preparation of cans for recycling in accordance with the invention is illustrated in FIGS. 1–14, wherein like numerals represent like elements throughout the drawings. As shown in FIG. 1, the apparatus 10 in accordance with the invention comprises a gravity in-feed rack 12 for accepting cans to be cleaned and crushed by the apparatus 10. Preferably, the gravity in-feed rack 12 is supported by elevated support brackets 14 so that cans placed in the gravity in-feed rack 12 roll along respective guide rails 15 toward the left in FIG. 1. In addition, the guide rail 15 on one side is preferably elevated with respect to the guide rail 15 on the other side so that cans placed with their open end towards the elevated guide rail may be retained in the gravity in-feed rack 12 without the contents of the can spilling out onto the top of the apparatus 10. As better shown in FIG. 2, a sensor 13 may also be provided on or adjacent the gravity in-feed rack 12 for detecting whether the open end of the can is facing in the proper direction before the can is permitted to be fed into the apparatus 10 for cleaning and crushing. Preferably, sensor 13 inhibits operation of the apparatus 10 until the cans are aligned properly in the gravity in-feed rack 12. An appropriate alarm or message may be provided to the user to indicate that the can must be turned around.

Figures 4, 5:
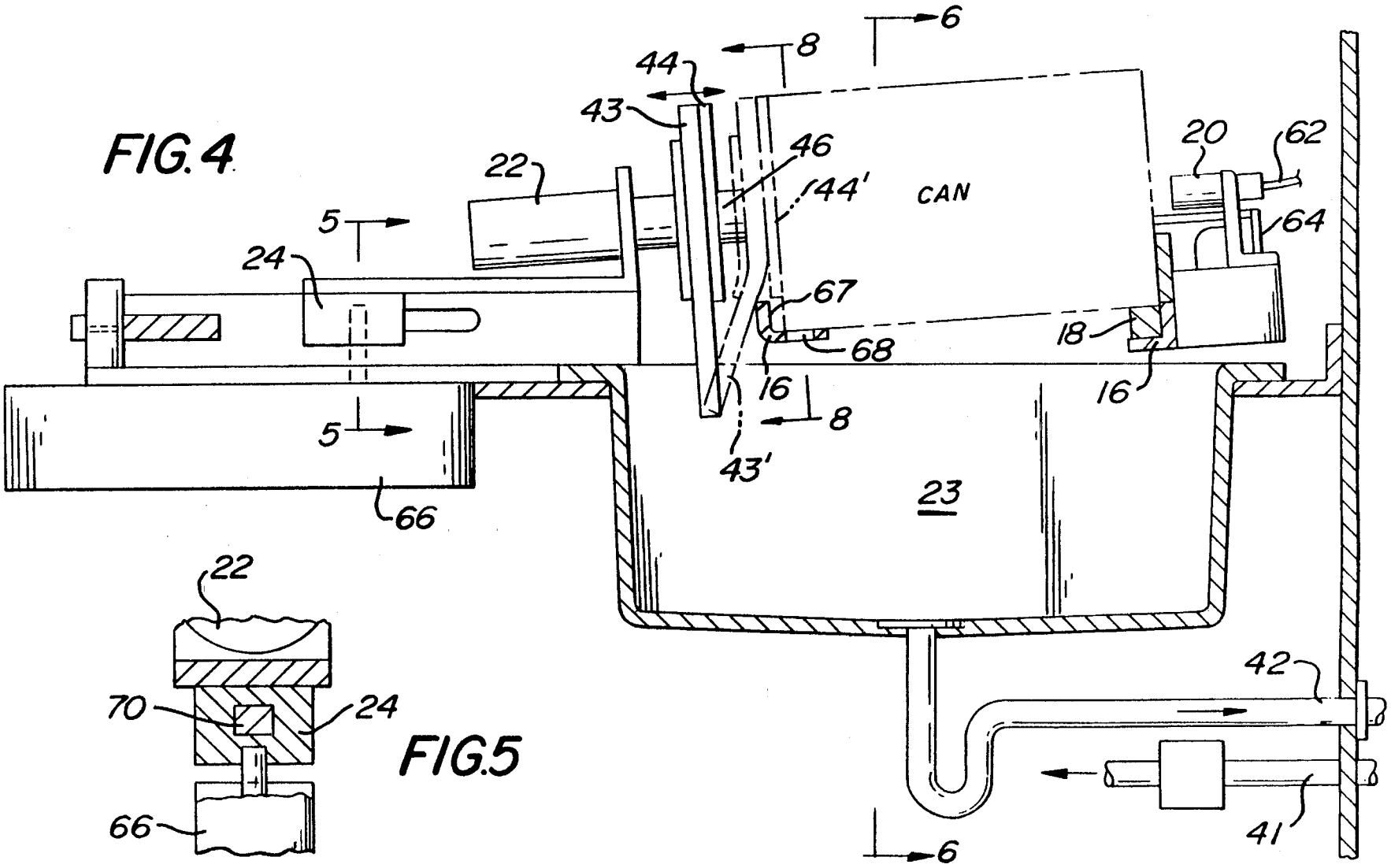
FIG. 4 is a sectional view taken along line 4—4 of FIG. 2 for better illustrating the cleaning station of the apparatus of FIG. 1.
FIG. 5 is a sectional view taken along line 5—5 of FIG. 4 for better illustrating the mechanism controlling movement of the flush head.

Cans from the gravity in-feed rack 12 enter the apparatus 10 via tracks 16. Preferably, one of the guide rails of tracks 16 includes an inclined portion 18 which tilts the bottom of the can upward and the open end of the can downward to facilitate drainage of the contents of the can during cleaning. As will be described in more detail below with respect to FIG. 6, gates 72 and 78 regulate the movement of cans into and out of the cleaning station. A photoelectric switch or acoustic sensor 20 is provided at the cleaning station for detecting the bottom of the can, and hence the presence of a can in the cleaning station. Preferably, the apparatus 10 is activated only when sensor 20 detects the bottom of a can and the apparatus 10 has been switched on. Once apparatus 10 is activated, flush head 22 is turned on for cleaning the inside of the can with a cleaning fluid such as water as will be better described below with respect to FIG. 4. The contents of the can and the fluid from the flush head 22 are disposed of through drain 23 disposed beneath the cleaning station. As will also be described in more detail with respect to FIG. 4, flush head support 24 moves the flush head 22 toward the can upon actuation until the can is trapped against the face of the flush head 22. As best illustrated in FIG. 4, the face of the flush head 22 includes flaps 43 and 44 which prevent excessive splashing of fluid from the can during the cleaning operation.

Figure 3:
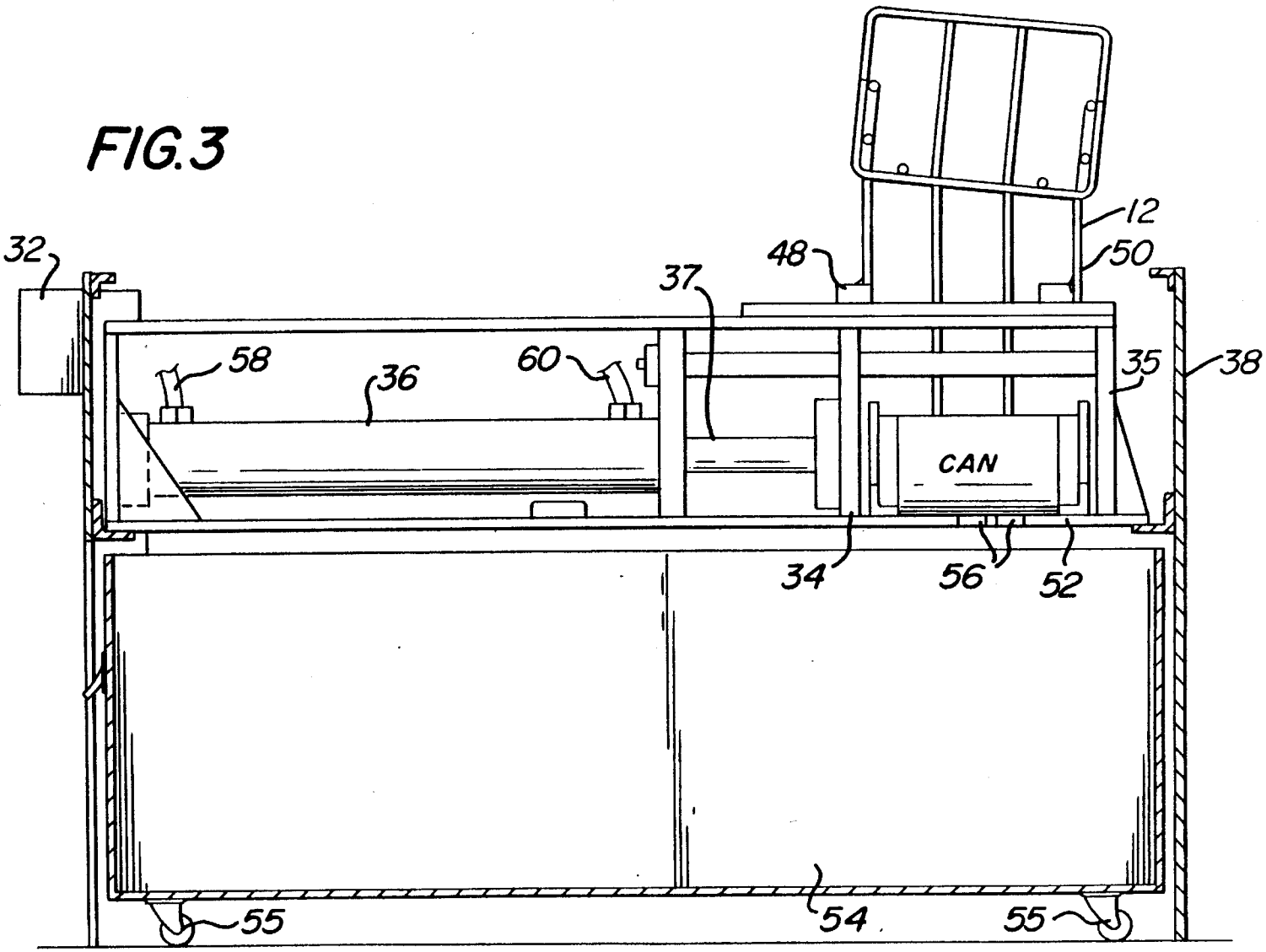
FIG. 3 is a sectional view taken along line 3—3 of FIG. 2 for better illustrating the crushing station of the apparatus of FIG. 1.

Cans which have been cleaned by flush head 22 exit from the cleaning station down the guide rails 16 into a crushing station including movable platen 34 and fixed platen 35 (FIG. 3). Movable platen 34 is operated by hydraulic ram 36 which receives hydraulic pressure from hydraulic pump motor 26 to drive the platen 34 along a guide rod 37.

As will be described in more detail below with respect to FIG. 13, electronics 28 are also provided behind a control panel 30 for controlling operation of the invention. On/Off switches 32 are also provided for enabling the user to activate the machine, although, as noted above, activity does not begin until a can is detected by sensor 20.

The above-mentioned components are enclosed within an outer casing 38 which further includes a top cover (not shown) for protecting the internal components. Preferably, outer casing 38 includes removable panels which facilitate access to the internal components for cleaning or service. A hopper chamber 40 is also provided within the outer casing 38 beneath the crushing station for accepting a wheeled hopper 54 as better illustrated in FIG. 3.

Figure 2:
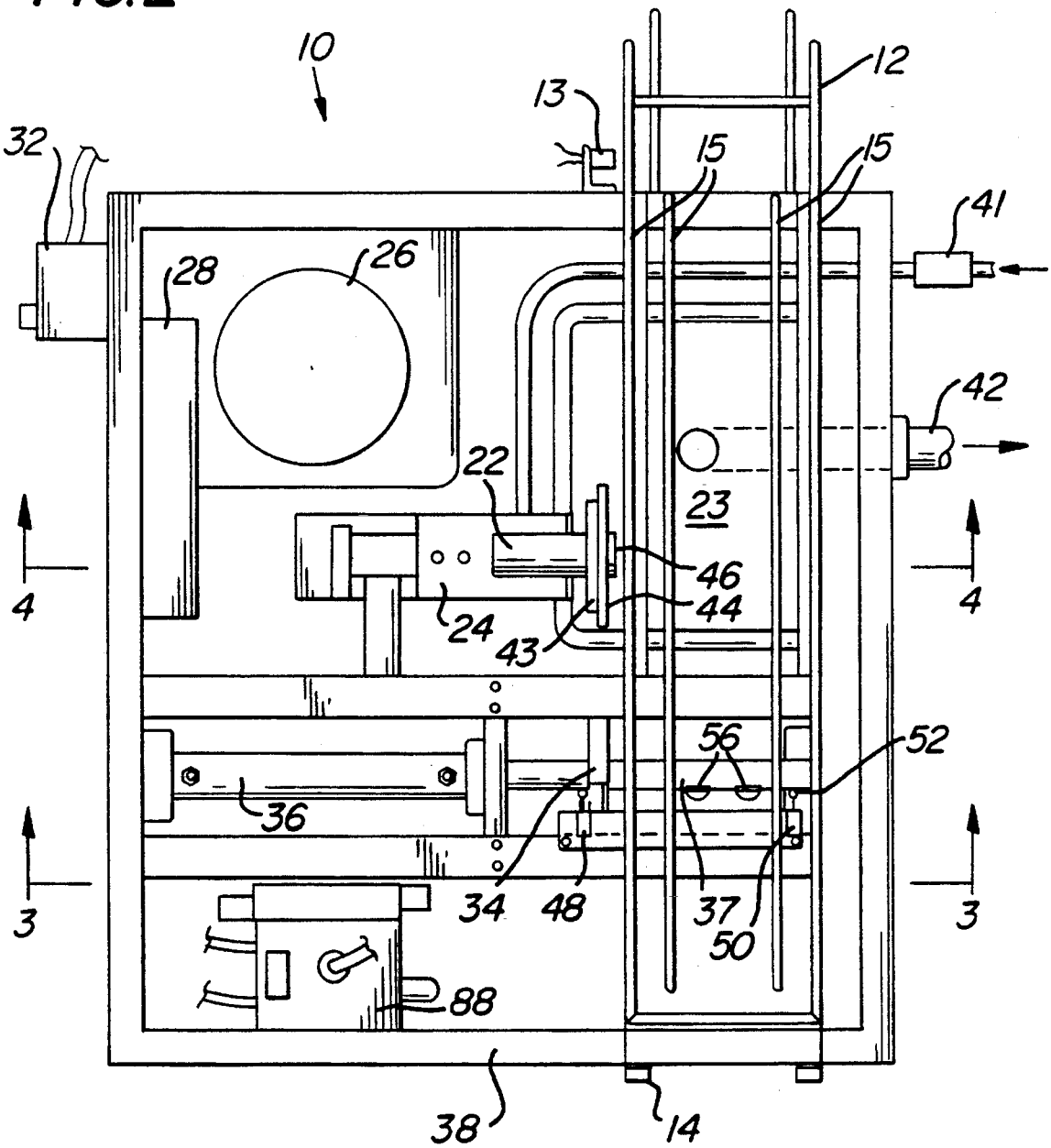
FIG. 2 is a top plan view of the apparatus of FIG. 1.

As illustrated in FIG. 2, the flush head 22 receives a cleaning fluid such as water via a water valve 41 connected to a water supply. Water and residue from the can pass from drain 23 to the sewage system via pipe 42. As best shown in FIG. 4, the flush head 22 further comprises a splash guard 43 and a sealing flap 44 adjacent nozzle 46 for effectively sealing off the open end of the can when the flush head is in cleaning position. As illustrated in FIG. 4, a drainage opening 67 in the sealing flap 44 is preferably provided at the lower portion of the open end of the can in order to facilitate draining.

Figure 10:
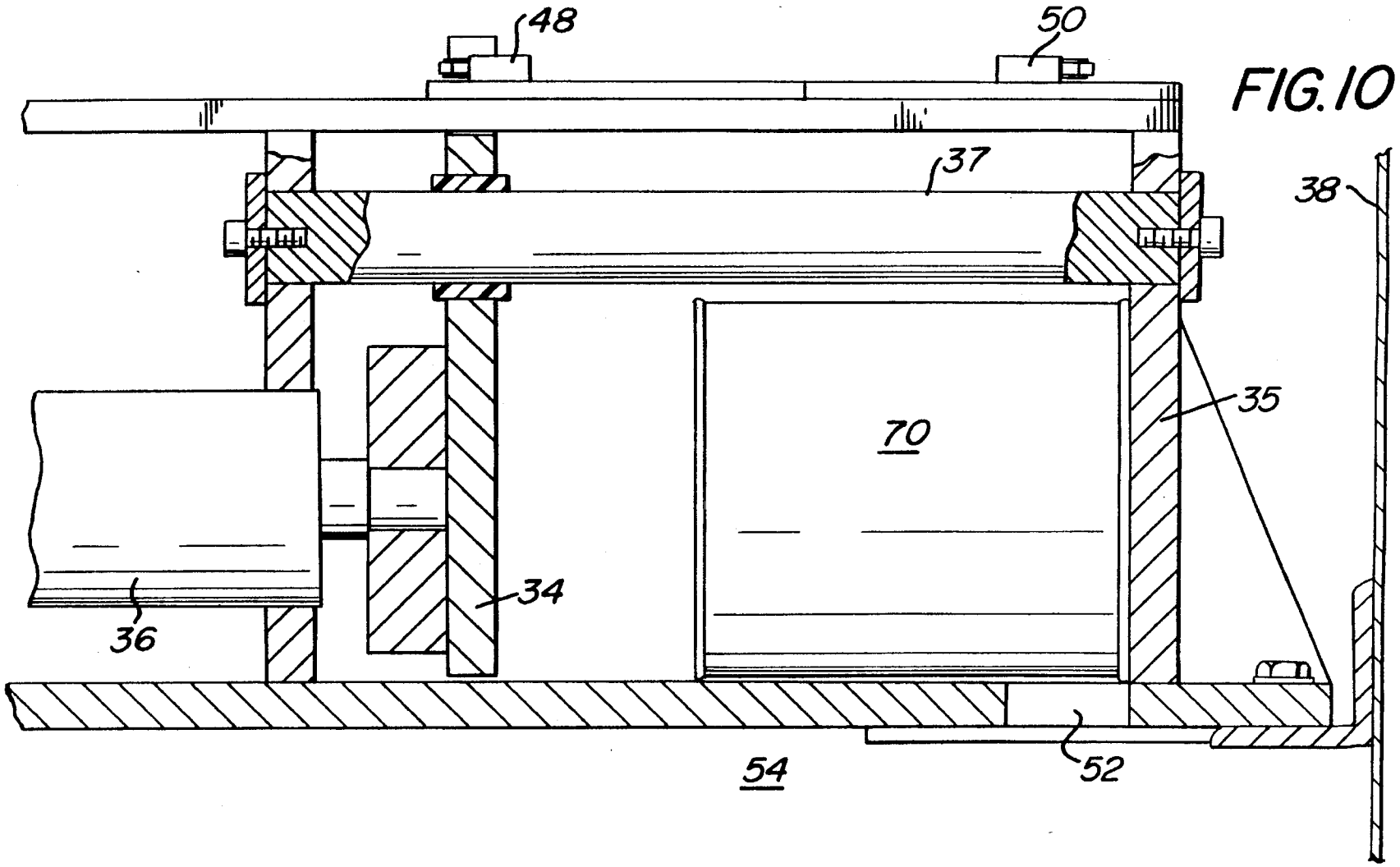
FIG. 10 illustrates a can in the crushing station prior to the crushing operation.
Figure 11:
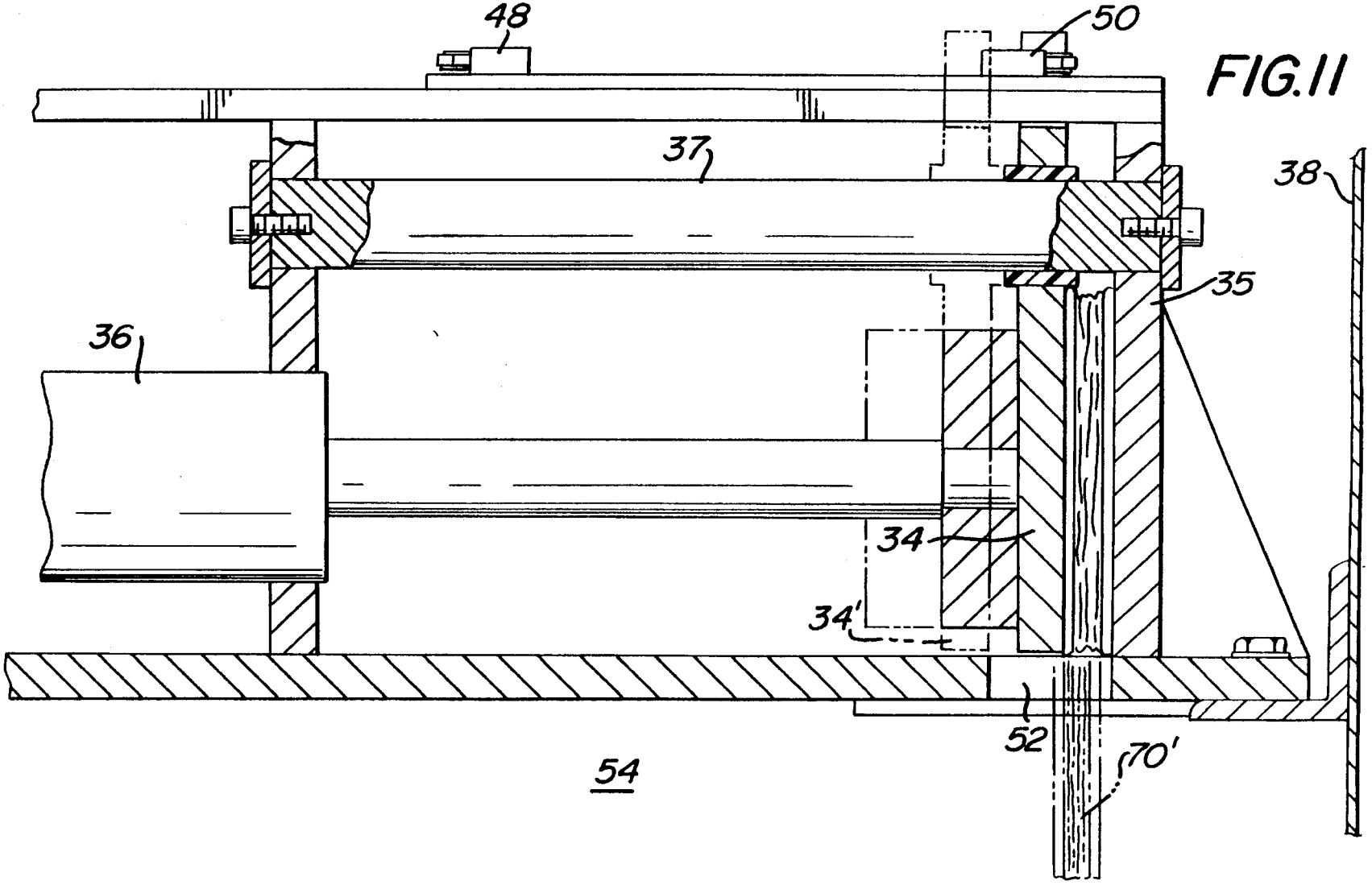
FIG. 11 illustrates a can in the crushing station after the crushing operation for illustrating how the crushed can is guided through a slot into the hopper.

As shown in FIGS. 2 and 3, the crushing station is disposed at the bottom end of the tracks 16 and accepts a can which has been cleaned by the flush head 22 and moved into the crushing station along the tracks 16 by the force of gravity. The crushing station includes first and second photoelectric switch sensors 48 and 50 for detecting whether the movable platen 34 is in its fully opened (sensor 48) or fully compressed (sensor 50) state. As best illustrated in FIGS. 10 and 11, the crush station further includes a slot 52 through which a crushed can falls into hopper 54 below. Preferably, the hopper includes wheels 55 for facilitating emptying of the hopper. Also, in accordance with a preferred embodiment of the crushing station, magnets 56 are provided for holding the can in place prior to the application of a compressive force against the can by the movable platen 34. Magnets 56 prevent the cans from bouncing out of the crushing station and from being misaligned during the crushing operation.

FIG. 4 illustrates the cleaning station of the invention. As shown, sensor 20 is connected to electrical power via line 62 and is mounted on bracket 64 at a position for facilitating detection of the bottom of the can. As noted above, the cleaning and crushing operations begin when the bottom of the can is detected by sensor 20. The cleaning activity begins by providing a control signal to solenoid 66, which, in turn, moves flush head support 24 and flush head 22 towards the open end of the can. As the flush head 22 moves forward, the sealing flap 44 comes into contact with the outer diameter of the open end of the can such that nozzle 46 is inside the can. After approximately one inch of further travel, a relay (FIG. 13) opens the water valve 41 to charge the flush head and apply water under pressure to the inside of the can. The water valve 41 is closed when the flush head support 24 retracts. The positions of the flaps 43 and 44 during cleaning are illustrated at 43' and 44' in FIG. 4. As shown, when the flush head 22 is in the cleaning position, drainage opening 67 is preferably provided at the bottom portion of the sealing flap 44 and a drainage slot 68 is preferably provided in the track 16 to facilitate drainage of the contents of the can into the drain 23.

As best shown in FIG. 5, solenoid 66 moves flush head support 24 along rod 70 during movement of the flush head 22 towards the can. However, those skilled in the art will appreciate that the electrical solenoid 66 may be replaced by a hydraulic ram similar to hydraulic ram 36 which drives platen 34 of the crushing station.

Figure 6:
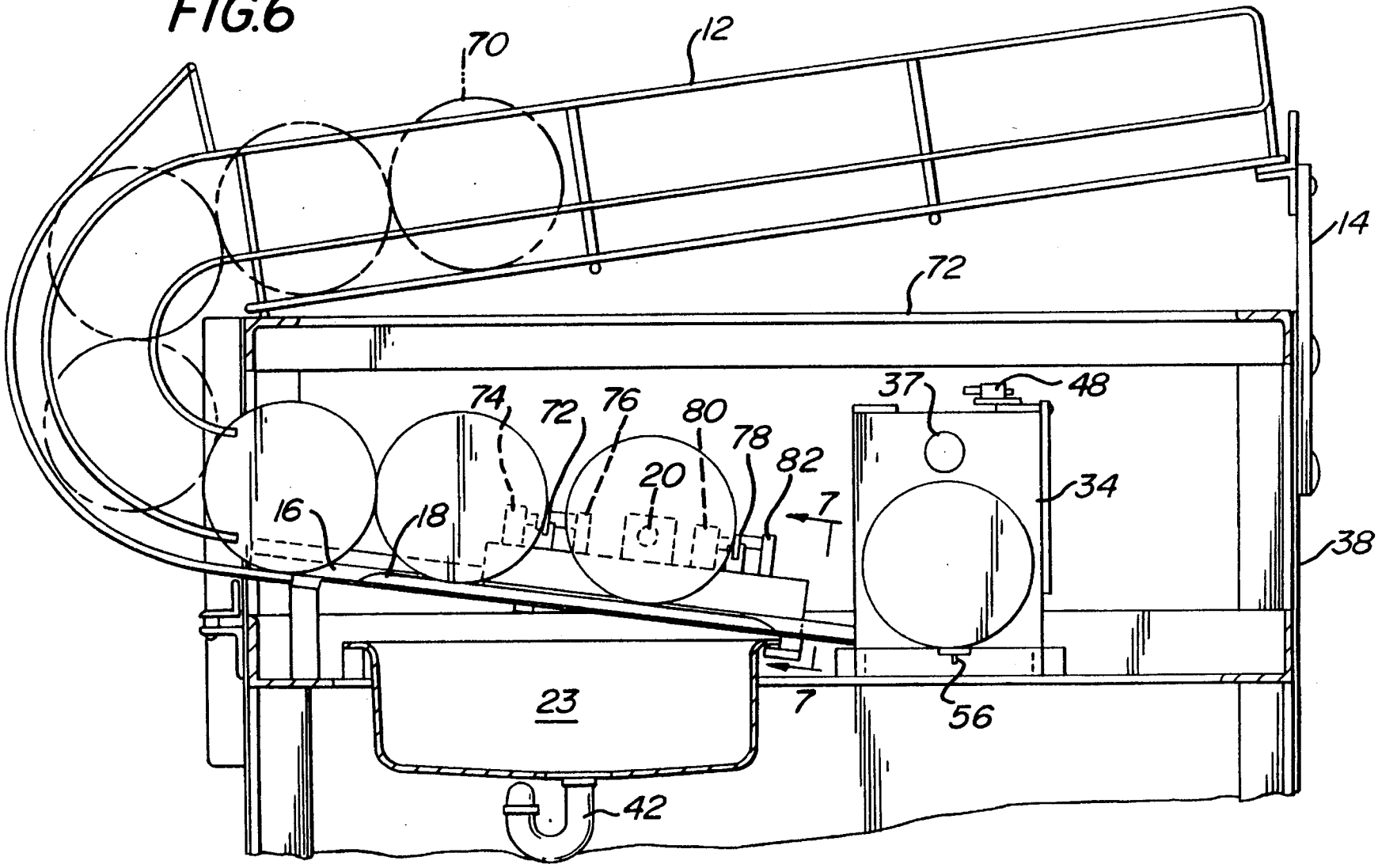
FIG. 6 is a sectional view taken along line 6—6 of FIG. 4 for better illustrating how cans are fed from the in-feed rack to the cleaning station and then to the crushing station.

As shown in FIG. 6, during operation, cans 70 are placed on the gravity in-feed rack 12 and fed down to track 16. As shown, the bottom ends of the cans 70 encounter a raised portion 18 in the track 16 which effectively tilts the bottom of the can upward to facilitate drainage of the contents of the can out of the open end of the can into the drain 23. The tilted cans then continue down track 16 until they encounter a first gate 72, which prevents the cans from passing unimpeded into the cleaning station. As will be described in more detail below with respect to FIG. 13, gate 72 is opened by an opening relay 74 and closed by a closing relay 76. When gate 72 is open to permit passage of a can 70 into the cleaning station, sensor 20 detects the bottom of the can and begins operation of the cleaning and crushing routines described below with respect to FIG. 14. At the conclusion of the cleaning operation, a second gate 78 is opened by an opening relay 80 to permit the cleaned can to pass into the crushing station. The second gate 78 is then closed by a closing relay 82. After a predetermined amount of time has elapsed to permit the can to settle into the crushing station and be held by magnets 56, the crushing operation begins.

Figure 7:
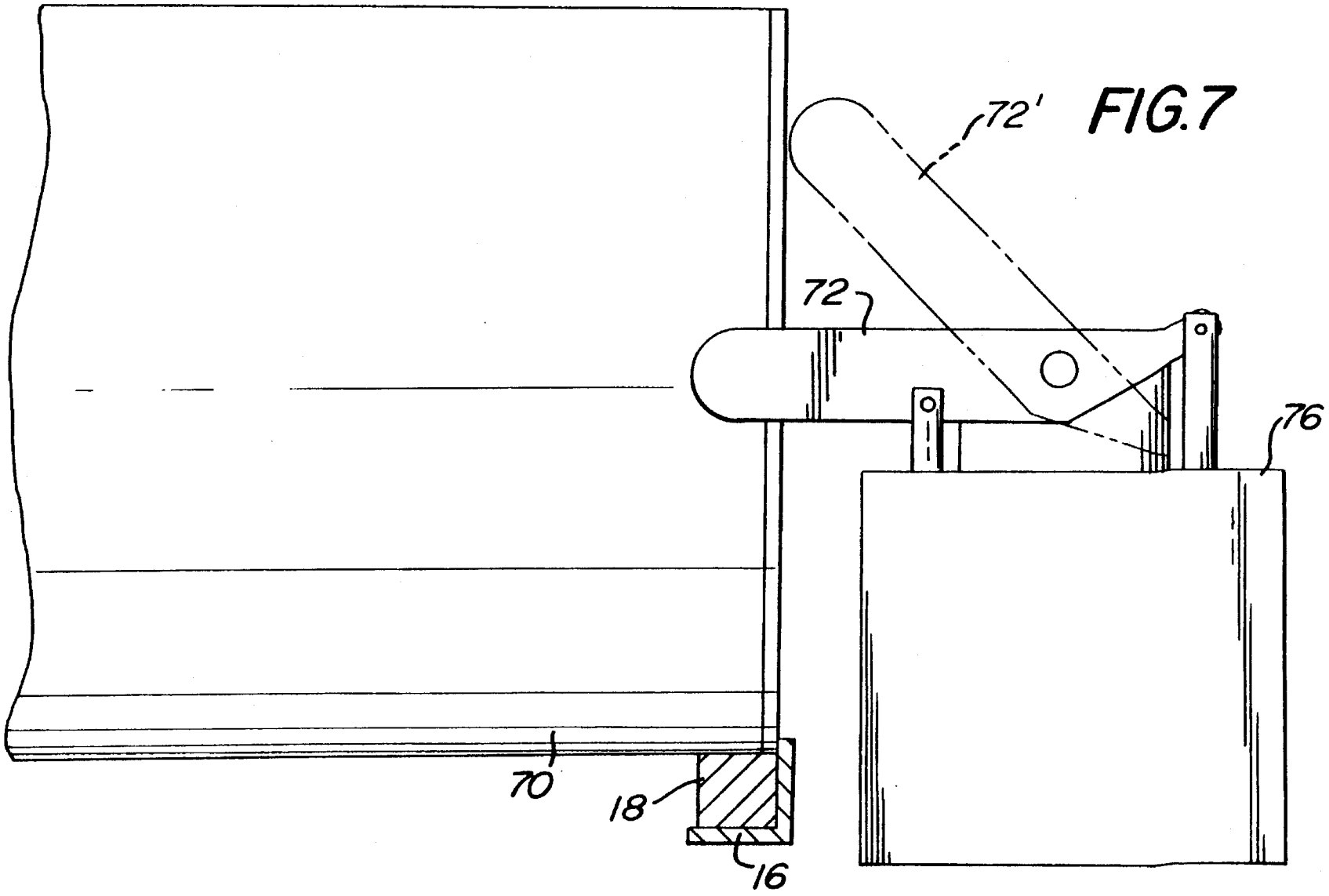
FIG. 7 is a sectional view taken along line 7—7 of FIG. 6 for better illustrating the gates which regulate movement of the cans into and out of the washing and crushing stations.

FIG. 7 illustrates the operation of the first gate 72. Second gate 78 operates in a similar manner. As shown, first gate 72 extends out far enough to prevent the can 70 from passing unimpeded into the cleaning station. Upon initiation of the apparatus 10 and after completion of a previous cleaning cycle, gate 72 is opened to the position 72' to permit the can 70 to pass into the cleaning station.

Figure 8:
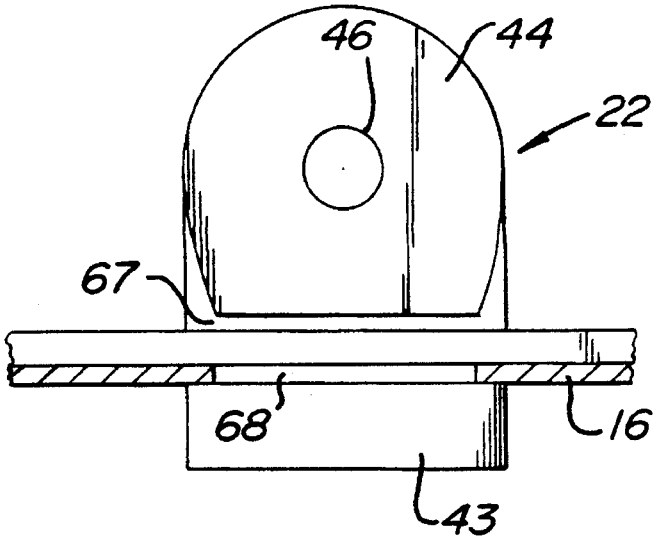
FIG. 8 is a sectional view taken along line 8—8 of FIG. 4 for better illustrating the flush head of the invention.

FIG. 8 illustrates the portion of the flush head 22 which faces a can during cleaning. As illustrated, sealing flap 44 is preferably truncated at the bottom to provide the drainage opening 67 which permits water and residue from the can to pass out of the can and through drainage slot 68 of rail 16 down into drain 23.

Figure 9:
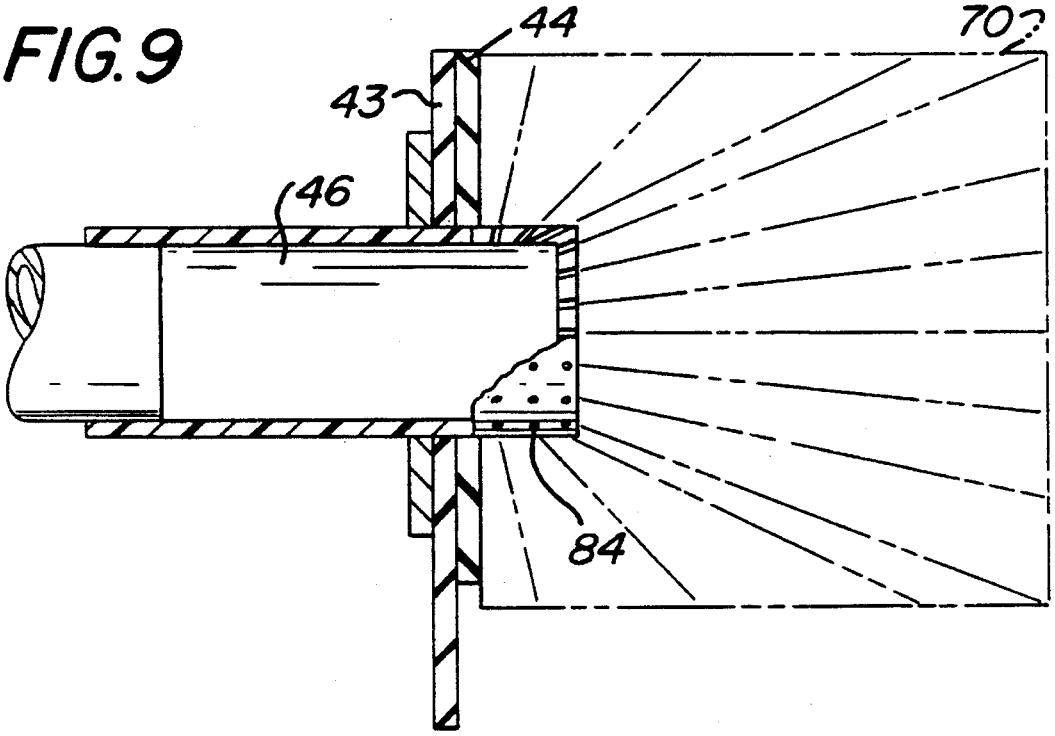
FIG. 9 is a side view of the flush head during cleaning of a can.

FIG. 9 illustrates the cleaning operation when the nozzle 46 is inserted into the can 70 during cleaning. As shown, spray holes 84 are provided in the nozzle 46 to facilitate the spraying of a cleaning fluid such as water in all directions within the can 70. Sealing flap 44 and splash flap 43 function to keep the water from splashing out of the can and to direct the water and residue into the drain 23.

FIG. 10 illustrates a can in the crushing station prior to crushing, while FIG. 11 illustrates a can in the crushing station after crushing. As shown in FIG. 11, hydraulic ram 36 pushes movable platen 34 forward with sufficient force to compact the can lengthwise against the fixed platen 35 to a height of approximately ⅝ inch plus or minus 1/16 inch thickness. In a preferred embodiment, hydraulic ram 36 applies 5 tons of pressure to the can 70. Once sensor 50 detects the movable platen 34 (and hence that the can is completely crushed), hydraulic ram 36 stops the movable platen 34 and then retracts the movable platen 34 approximately ½ inch to position 34' at the edge of the slot 52 so that the crushed can 70' may drop through slot 52 into the hopper 54. The movable platen 34 is stopped at position 34' for a time interval of approximately 2–3 seconds to prevent the crushed can 70' from falling back into the crushing station. At the conclusion of this time interval, hydraulic ram 36 retracts the movable platen 34 to its rest position, which is detected by sensor 48. The crushing station then waits for receipt of the next can.

Figure 12:
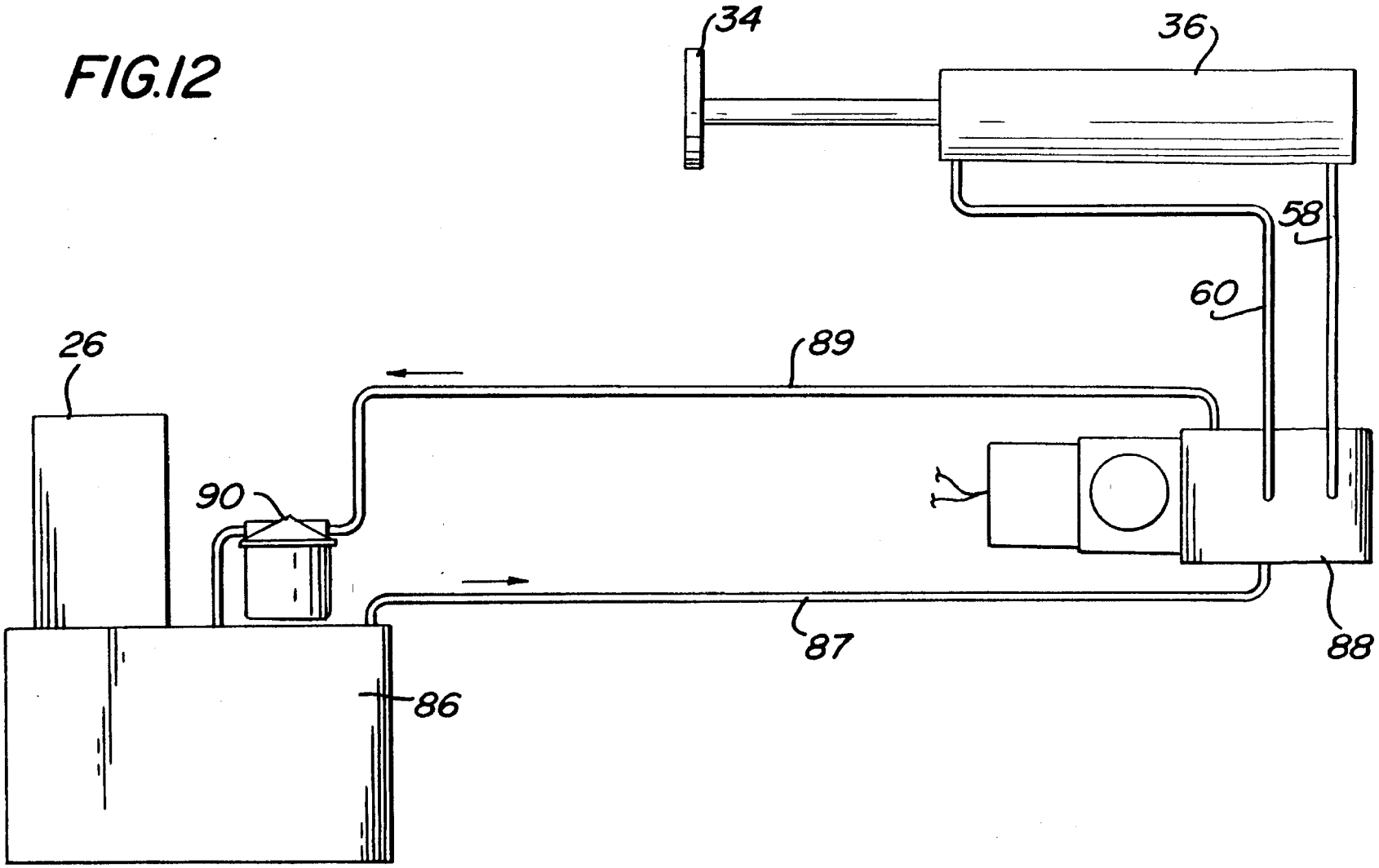
FIG. 12 illustrates a plan view of the hydraulic system for driving the movable platen of the crushing station in accordance with the invention.

FIG. 12 illustrates a preferred embodiment of the hydraulic system for operating hydraulic ram 36 in accordance with the invention. As shown, hydraulic pump 26 pumps fluid from a reservoir 86 via line 87 to a hydraulic cylinder 88 containing a piston which provides the pressurized fluid to hydraulic ram 36 via tubes 58 and 60, respectively. The hydraulic fluid is then returned through line 89 to the reservoir 86 via a filter 90 before being recirculated back via tube 87 to cylinder 88. A similar mechanism may also be provided for providing hydraulic pressure to a hydraulic ram used in place of the solenoid 66 for driving the flush head 22. In the preferred embodiment, the hydraulic pump 26 is a one horse power motor which operates at 110 volts, and reservoir 86 is a 3–5 gallon tank.

Figure 13:
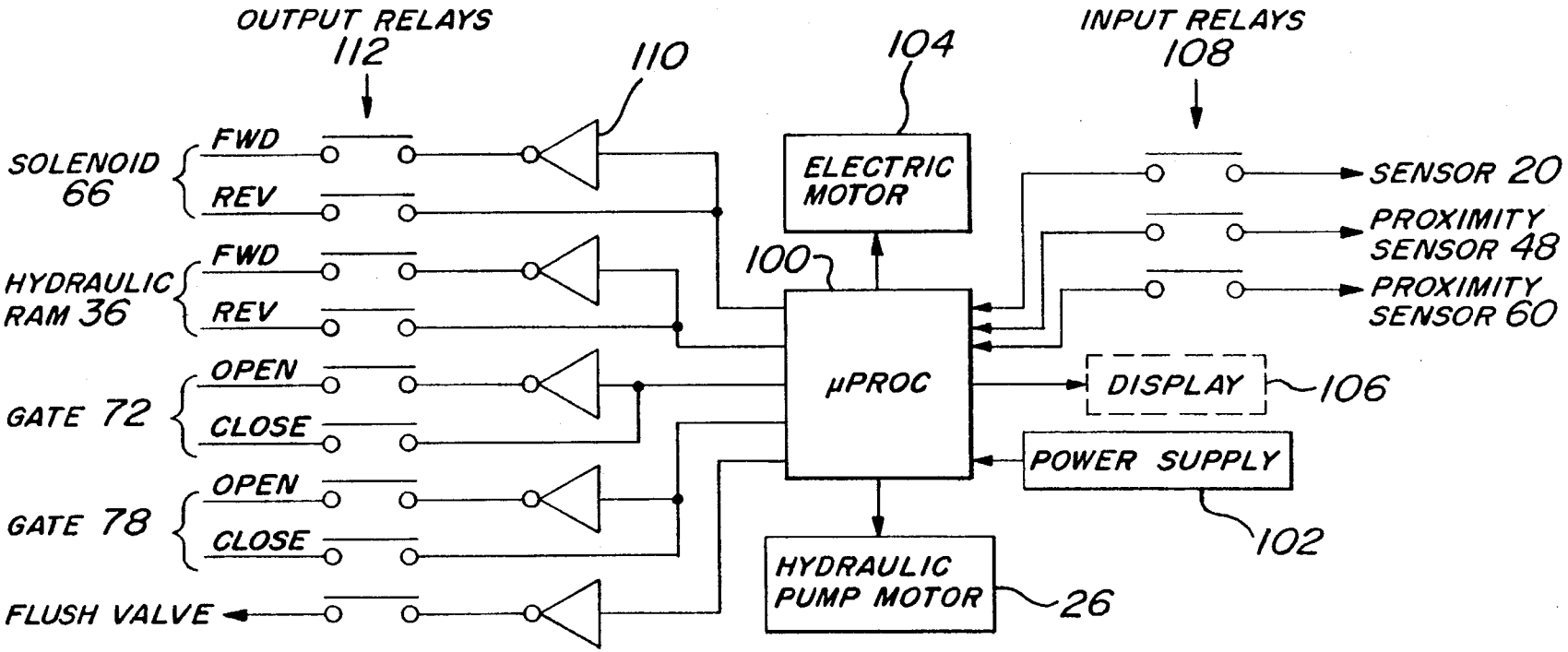
FIG. 13 illustrates the control circuitry which controls operation of the cleaning and crushing stations as well as the gates for regulating movement of the cans between the cleaning and crushing stations.

FIG. 13 illustrates the electronic control system of the invention. As illustrated, a microprocessor 100 powered by a power supply 102 is provided for controlling hydraulic motor 26 and an electric motor 104 which provides electrical current to all electrical components, including solenoid 66. Microprocessor 100 may have a display 106 for displaying operational instructions, error messages and the like via control panel 30 to a user of the apparatus 10.

Microprocessor 100 controls movement of the cans between the cleaning and crushing stations. As illustrated in FIG. 13, input relays 108 apply detector outputs from sensor 20, sensor 48 and sensor 50 to the microprocessor 100 for initiating the correct operation as fully described below with respect to FIG. 14. Although not shown, microprocessor 100 may also receive an input from sensor 13 for disabling the apparatus 10 and/or causing the microprocessor 100 to issue an error message instructing the user to turn the can around in the gravity in-feed rack 12.

Based upon the input received via input relays 108, microprocessor 100 selectively controls solenoid 66, hydraulic ram 36, gate 72, gate 78, and water valve 41. As shown in FIG. 13, inverters 110 are provided so that only one output relay 112 to each of the respective components is actuated at any given time. In particular, solenoid 66 and hydraulic ram 36 are driven either in the forward or reverse directions, while gates 72 and 78 are driven open or closed by control signals output from microprocessor 100. At the appropriate time, a control signal from microprocessor 100 also turns on the water valve 41 so that water is applied to the flush head 22.

In a preferred embodiment, microprocessor 100 includes software routines for controlling operation of the apparatus 10. Such software will now be described with respect to FIGS. 14A and 14B.

Figure 14A:
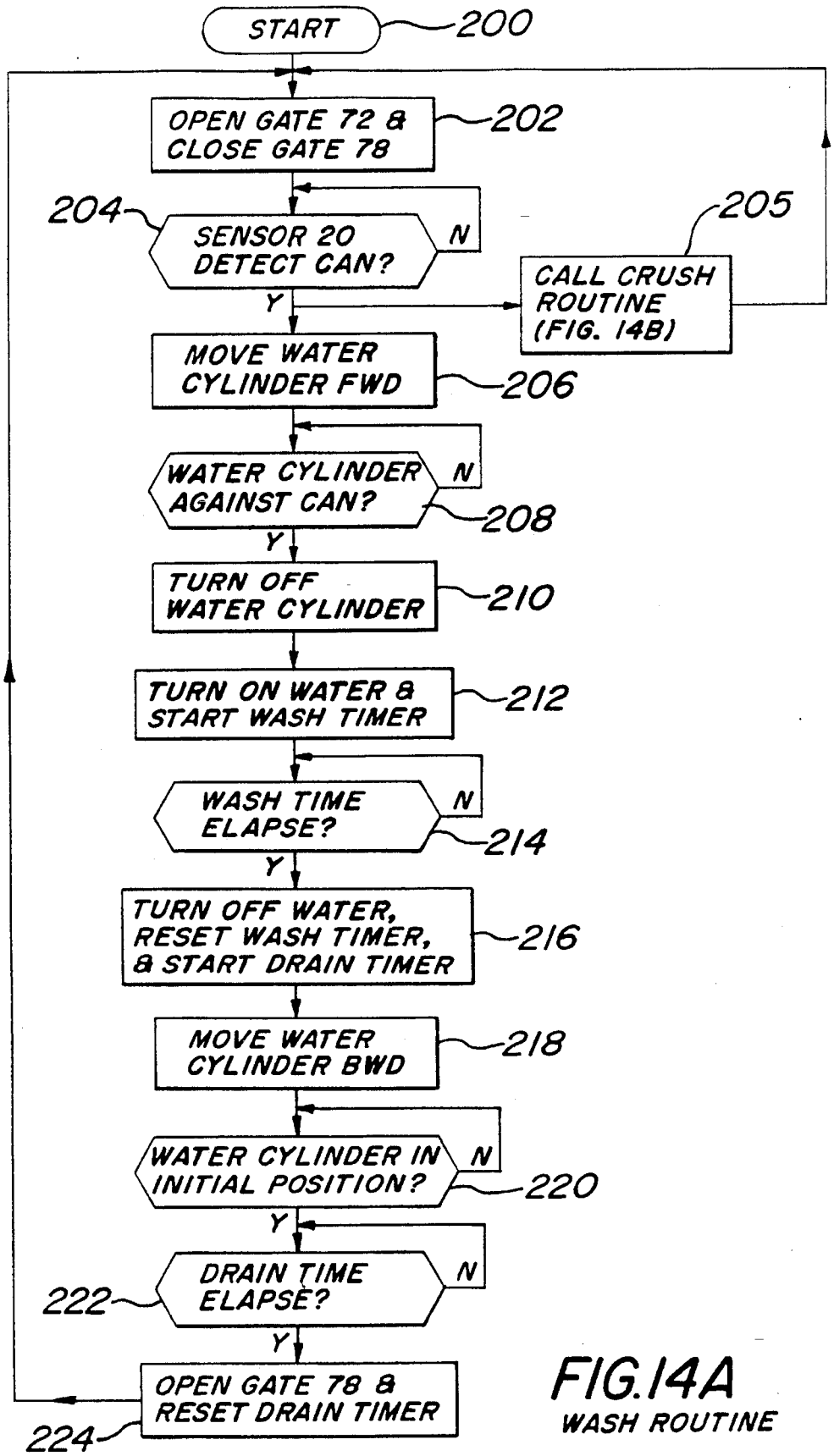
FIG. 14A illustrates a wash routine implemented in software by microprocessor 100 of FIG. 13.

The wash routine is illustrated in FIG. 14A. This routine starts at step 200 and is initialized at step 202 by opening gate 72 and closing gate 78. This permits an incoming can to roll directly into the cleaning station. The system then waits at step 204 for an output from sensor 20 indicating that the bottom of a can has been detected. Upon detection of the bottom of a can by sensor 20, the crush routine (FIG. 14B) is called at step 205 and the cleaning operation begins at step 206. The crushing operation operates in parallel with the cleaning operation and will be described below with respect to FIG. 14B. To start the cleaning operation, microprocessor 100 sends a control signal at step 206 to solenoid 66 instructing the solenoid 66 to move the flush head 22 forward. Solenoid 66 then moves the flush head 22 forward until it is determined at step 208 that the flush head 22 is flush against the open end of the can. As noted above, the flush head 22 may move another inch or so before microprocessor 100 sends a control signal at step 210 opening the output relay 112 to the solenoid 66 to thereby stop forward movement of the flush head 22. Microprocessor 100 then sends a control signal at step 212 to an electric switch controlling water valve 41 to turn on the water. Microprocessor 100 also starts a wash timer at step 212. Water is applied to the interior of the can as illustrated in FIG. 9 until it is determined at step 214 that the wash time has elapsed. At the end of the wash time, the water is turned off, the wash timer is reset, and a drain timer is started at step 216. Microprocessor 100 then sends a control signal at step 218 to the solenoid 66 to cause it to retract the flush head 22 until it is detected at step 220 that the flush head 22 is back in its initial position. It is next determined at step 222 whether the drain time has elapsed, and if so, gate 78 is opened and the drain timer is reset at step 224. The wash cycle is then repeated if another can is detected by sensor 20.

Figure 14B:
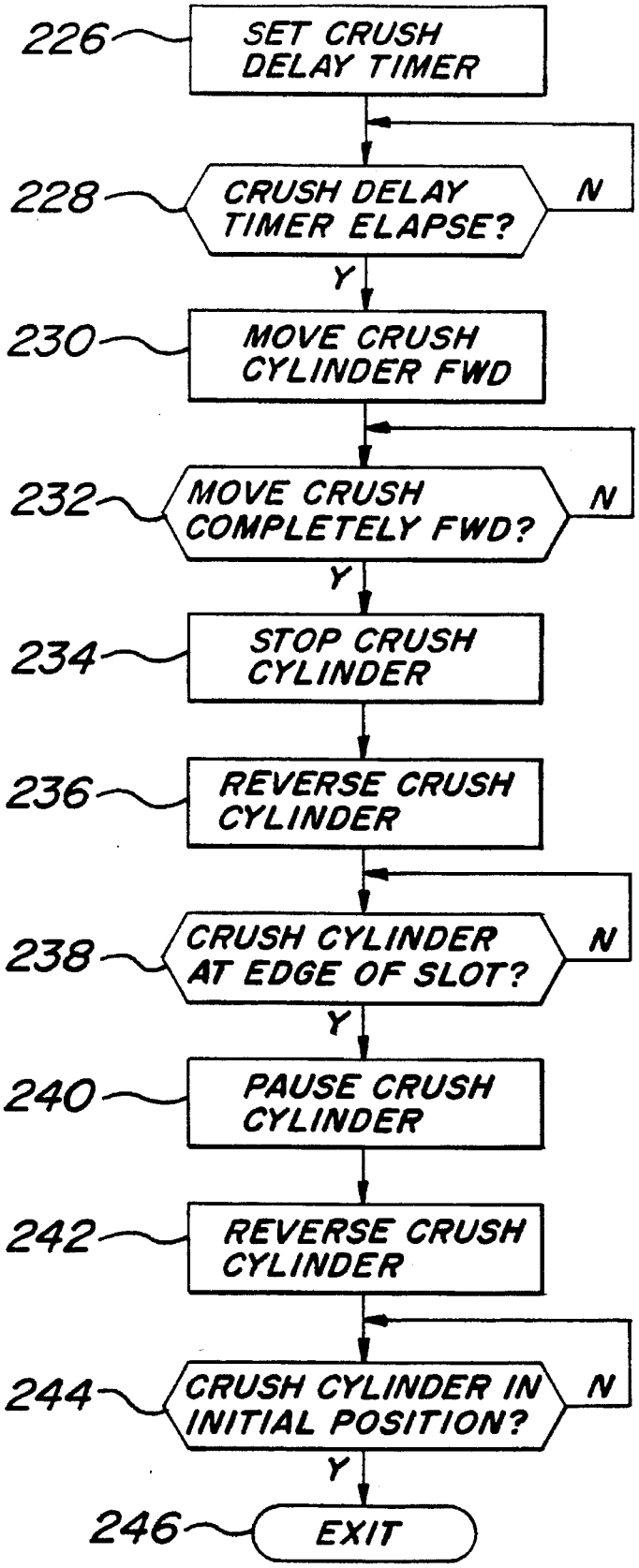
FIG. 14B illustrates a crush routine implemented in software by microprocessor 100 of FIG. 13.

FIG. 14B illustrates a crush routine in accordance with the invention. As shown in FIG. 14B, the crush routine starts at step 226 by setting the crush delay timer. The crush delay timer permits sufficient time for the can to roll from the cleaning station into the crushing station prior to operation of the crushing station. Those skilled in the art will appreciate that during the first iteration of the crush routine that the hydraulic ram 36 is actuated even though no can is present in the crushing station.

Once it is determined at step 228 that the crush delay timer has elapsed, microprocessor 100 sends a control signal to the hydraulic ram 36 at step 230 causing it to move platen 34 forward until photoelectric switch 50 detects at step 232 that the platen 34 is completely forward. The hydraulic ram 36 is then stopped at step 234. Microprocessor 100 then sends a control signal to hydraulic ram 36 at step 236 instructing it to retract until the platen 34 is at the edge of slot 52 (step 238). As shown in FIG. 11, the platen 34' is held at this position for approximately 2–3 seconds at step 240 to allow sufficient time for the crushed can 70' to fall into the hopper 55. Microprocessor 100 then retracts the hydraulic ram 36 at step 242 causing platen 34 to return to its initial position as detected by photoelectric sensor 48 at step 244. The crush operation is then completed and the crush routine is exited at step 246.

In a preferred embodiment of the invention, the in-feed rack 12 will hold twelve 6.25 inch diameter by 7 inch tall tin plated steel cans of the type used in commercial establishments such as restaurants. Of course, cans of having different diameters and height may be readily accommodated with minor adjustment. In accordance with the preferred embodiment, approximately three cans can be crushed to about ⅝ inch height per minute. The crushed cans fall through slot 52 down into the hopper 54 until it is full. As noted above, hopper 54 preferably has wheels 55 to facilitate emptying. In an optional embodiment, the hopper 54 may include a detector for shutting off the apparatus 10 when the hopper 54 is filled. A reset switch button may also be provided to stop operation of the apparatus 10 at any time so that the hopper may be emptied. Alternatively, a pause switch may be provided for the same purpose.

In an alternative embodiment, a drain station may be provided to facilitate faster movement of the cans through the apparatus 10. Such a drain station may comprise a cam for elevating the back of the can to facilitate draining.

In another alternative embodiment of the invention, the lower portion of the gravity in-feed rack 12 may be replaced by a wheel controlled by a pneumatic rotary vane actuator to "shoot" the cans into the cleaning station one can at a time. Such an embodiment would prevent the binding of the gate 72 which may occur because of the weight of the cans placed in the gravity in-feed rack 12. Indeed, such a wheel would render gate 72 unnecessary. In this embodiment, microprocessor 100 would selectively feed the cans into the cleaning station as the previous can is moved to the crushing station.

In yet another alternative embodiment, the washing station and the crushing station may be combined into a common station by placing the flush head 22 in the platen 34 so that water can be sprayed inside the open end of the can from the nozzle 46 prior to crushing the can. In this embodiment, after the can is rinsed, the movable platen will continue to move forward to crush the can against the fixed platen until it is of the desired height. Operation otherwise would be the same as that described above.

In still further alternative embodiments, both the fixed platen 35 and the movable platen 34 of the crushing station may contain specially shaped protrusions that promote crushing and reduce the power required in crushing. Also, the hopper 54 may have a pan lining the bottom to catch dripping water from the crushed cans. A movable nozzle also may be attached to the internal plumbing by a flexible extension hose for use in cleaning the apparatus 10.

In further alternative embodiments, a slot may be provided in the cover of the apparatus 10 for accepting can lids. In such an embodiments, the lids may alternatively slide into a rinsing area with its own nozzle and then slide into the hopper 54 or a separate basket for storage. In addition, a label removing device may be placed on the top of the apparatus 10 to facilitate removal of the label prior to placement of the can on the gravity in-feed rack 12. Similarly, a device such as a rotating slitter, circumferential plunging shear, or a slitting blade may be placed on the top of the apparatus 10 to facilitate removal of the can lid.

Although exemplary embodiments of the invention have been described in detail above, those skilled in the art will readily appreciate that many additional modifications are possible ill the exemplary embodiment without materially departing from the novelties and advantages of the invention. For example, the hydraulic system for driving the platen 34 may be replaced by an electrical system for driving a solenoid, and vice-versa. Similarly, the gates 72 and 78 may be driven hydraulically. Indeed, hydraulic actuators are generally preferred because of their longevity in the damp environment of the invention. Also, the crushing mechanism of the invention may be replaced by a scissor-type platen press with platens hinged together at one end or a combination of divergent belts or powered rollers that are in close proximity at one end and function to draw the body of the can through a narrow slot. Alternatively, a mechanically operated hydraulic screw jack or pneumatic cylinder may be used as well. Accordingly, all such modifications are intended to be included within the scope of this invention as defined in the following claims.

We claim:

1. An automated device for preparation of cans for recycling, comprising:

cleaning means for providing a cleaning fluid under pressure into an interior of a can to be recycled;

means for feeding cans to said cleaning means and holding said cans so that an open end of each can faces said cleaning means during cleaning by said cleaning means;

crushing means for crushing a can cleaned by said cleaning means to a substantially reduced volume; and control means for controlling respective operations of said cleaning means and said crushing means and for disabling operation of at least said cleaning means when an open end of said can is not correctly aligned to face said cleaning means.

2. An automated device as in claim 1, further comprising a hopper disposed adjacent said crushing means for collecting cans which have been cleaned and crushed by said cleaning means and said crushing means, respectively.

3. An automated device as in claim 1, wherein said cleaning means comprises a drain and a flush head connected to a water source, said flush head comprising a nozzle for spraying water under pressure into said interior of said can.

4. An automated device as in claim 3, wherein said cleaning means further comprises means responsive to said control means for inserting said flush head into said can during cleaning and for removing said flush head from said can after a predetermined wash time.

5. An automated device as in claim 4, wherein said cleaning means further comprises a sealing flap disposed about said flush head adjacent said nozzle for substantially closing an open end of said can when said flush head is inserted into said can during cleaning except for a drainage opening at a portion of said open end of said can adjacent said drain, and a splash flap disposed about said flush head on a side of said sealing flap opposite said nozzle for substantially preventing water from splashing out of said drainage opening during cleaning.

6. An automated device as in claim 1, wherein said feeding and holding means comprises a gravity in-feed rack having first and second parallel rails for supporting a plurality of said cans, said first parallel rail being elevated with respect to said second parallel rail whereby a can placed with an open end adjacent said first parallel rail is substantially prevented from spilling residue from said can.

7. An automated device as in claim 6, wherein said feeding and holding means further comprises a track for guiding cans from said gravity in-feed rack to said cleaning means, said track containing first and second parallel guide rails for supporting a plurality of said cans, said second parallel guide rail being remote from said flush head and being elevated with respect to said first parallel guide rail located adjacent said flush head so as to facilitate drainage of said cleaning fluid from said can during cleaning.

8. An automated device as in claim 1, wherein said crushing means comprises a hydraulic ram responsive to said control means for driving a first platen from a rest position toward a second platen for compressing a can therebetween.

9. An automated device as in claim 8, wherein said crushing means further comprises a slot adjacent said second platen through which a crushed can falls when said first platen is moved a predetermined distance away from said second platen after crushing of said can.

10. An automated device as in claim 9, wherein said crushing means further comprises means for detecting when said first platen has been moved said predetermined distance away from said second platen after crushing of said can, said detecting means instructing said control means to stop movement of said first platen for a predetermined time period before resuming movement of said first platen to said rest position, whereby said crushed can is permitted to pass through said slot and out of said crushing means prior to said resumption of movement of said first platen to said rest position.

11. An automated device as in claim 8, wherein said crushing means further comprises a magnet for holding said can in place until said first platen applies a compressive force against said can.

12. An automated device as in claim 1, wherein said control means comprises a microprocessor and a sensor disposed with respect to said cleaning means so as to detect the presence of a can in a position ready for cleaning by said cleaning means, whereby said sensor initiates a can cleaning and crushing operation upon detection of the presence of said can in said position ready for cleaning by said cleaning means.

13. An automated device as in claim 12, wherein said control means further comprises a first gate responsive to said microprocessor for regulating the passage of said cans to said position ready for cleaning by said cleaning means and a second gate responsive to said microprocessor for regulating the passage of cleaned cans from said cleaning means to said crushing means.

14. An automated device as in claim 13, wherein said control means further comprises a plurality of output relays responsive to said microprocessor for selectively applying control signals to said cleaning means and said crushing means and open and close signals to said first and second gates.

15. An automated device for preparation of cans for recycling, comprising:

in-feed means for accepting cans, for detecting an open end of each can, and for aligning open ends of said cans for recycling;

a track for guiding said aligned cans from said in-feed means to a first recycling station;

a flush head provided at said first recycling station for providing a cleaning fluid under pressure into an interior of a can at said first recycling station;

crushing means at a second recycling station for crushing cans cleaned by said flush head to a substantially reduced volume;

a hopper disposed adjacent said second recycling station for collecting cans which have been cleaned at said first recycling station and crushed at said second recycling station; and control means for controlling operation of said flush head and said crushing means, for controlling movement of cans among said in-feed means and said first and second recycling stations via said track, and for disabling operation of at least said flush head when the open end of a can is not correctly aligned to face said flush head when the can enters said first recycling station.

16. An automated device as in claim 15, further comprising a hydraulic pump and tubing for applying hydraulic pressure to said crushing means for controlling movement of said crushing means.

17. An automated device for preparation of cans for recycling, comprising:

cleaning means for providing a cleaning fluid under pressure into an interior of a can to be recycled, said cleaning means comprising a drain and a flush head having a nozzle for spraying water under pressure into said interior of said can, means for inserting said flush head into said can during cleaning and for removing said flush head from said can after a predetermined wash time, a sealing flap disposed about said flush head adjacent said nozzle for substantially closing an open end of said can when said flush head is inserted into said can during cleaning except for a drainage opening at a portion of said open end of said can adjacent said drain, and a splash flap disposed about said flush head on a side of said sealing flap opposite said nozzle for substantially preventing water from splashing out of said drainage opening during cleaning;

means for feeding cans to said cleaning means and holding said cans in place during cleaning by said cleaning means;

crushing means for crushing a can cleaned by said cleaning means to a substantially reduced volume; and control means for controlling insertion and removal of said flush head into said can during cleaning and for controlling respective operations of said cleaning means and said crushing means.

18. An automated device for preparation of cans for recycling, comprising:

cleaning means for providing a cleaning fluid under pressure into an interior of a can to be recycled;

a gravity in-feed rack having first and second parallel guide rails for supporting a plurality of said cans, feeding said cans to said cleaning means, and holding said cans in place during cleaning by said cleaning means, said first parallel guide rail being elevated with respect to said second parallel guide rail at positions remote from said cleaning means so that a can placed with an open end adjacent said first parallel guide rail is substantially prevented from spilling residue from said can;

crushing means for crushing a can cleaned by said cleaning means to a substantially reduced volume; and control means for controlling respective operations of said cleaning means and said crushing means.

19. An automated device as in claim 18, wherein said second parallel guide rail is remote from said flush head and is elevated with respect to said first parallel guide rail at a position adjacent said flush head so as to facilitate drainage of said cleaning fluid from said can during cleaning.

20. An automated device for preparation of cans for recycling, comprising:

cleaning means for providing a cleaning fluid under pressure into an interior of a can to be recycled;

means for feeding cans to said cleaning means and holding said cans in place during cleaning by said cleaning means;

crushing means for crushing a can cleaned by said cleaning means, said crushing means comprising a hydraulic ram which drives a first platen from a rest position toward a second platen for compressing said can to a substantially reduced volume, a slot adjacent said second platen through which said crushed can falls when said first platen is moved a predetermined distance away from said second platen after crushing of said can, and means for detecting when said first platen has been moved said predetermined distance away from said second platen after crushing of said can; and control means for initiating respective operations of said cleaning means and said crushing means and for stopping movement of said first platen for a predetermined time period before resuming movement of said first platen to said rest position so that the crushed can is permitted to pass through said slot and out of said crushing means prior to said resumption of movement of said first platen to said rest position.

21. An automated device for preparation of cans for recycling, comprising:

cleaning means for providing a cleaning fluid under pressure into an interior of a can to be recycled;

means for feeding cans to said cleaning means and holding said cans in place during cleaning by said cleaning means;

crushing means for crushing a can cleaned by said cleaning means to a substantially reduced volume, said crushing means comprising a hydraulic ram responsive to said control means for driving a first platen from a rest position toward a second platen for compressing a can therebetween and a magnet for holding said can in place until said first platen applies a compressive force against said can; and control means for controlling respective operations of said cleaning means and said crushing means.

* * * * *

UNITED STATES PATENT AND TRADEMARK OFFICE

CERTIFICATE OF CORRECTION

PATENT NO. : 5,488,899

DATED : February 6, 1996

INVENTOR(S) : Jack S. Jennings

It is certified that error appears in the above-indentified patent and that said Letters Patent is hereby corrected as shown below:

Col. 10, line 2, after "possible" change "ill" to --in--.

Signed and Sealed this

Sixteenth Day of July, 1996

Bruce Lehman

*Attest:*

BRUCE LEHMAN

*Attesting Officer*

*Commissioner of Patents and Trademarks*